US012735212B1

(12) United States Patent
Quinones

(10) Patent No.: US 12,735,212 B1
(45) Date of Patent: Sep. 15, 2026

(54) SYSTEM AND METHOD FOR PACKAGING MATERIAL SHEETS

(71) Applicant: Victor M Quinones, San Antonio, TX (US)

(72) Inventor: Victor M Quinones, San Antonio, TX (US)

(73) Assignee: CONCORD SUPPLY, INC., San Antonio, TX (US)

( * ) Notice: Subject to any disclaimer, the term of this patent is extended or adjusted under 35 U.S.C. 154(b) by 0 days.

(21) Appl. No.: 19/240,449

(22) Filed: Jun. 17, 2025

(51) Int. Cl.

| | |
|---|---|
| ***B65B 9/02*** | (2006.01) |
| ***B65B 13/02*** | (2006.01) |
| ***B65B 41/16*** | (2006.01) |
| ***B65B 51/02*** | (2006.01) |
| ***B65B 65/00*** | (2006.01) |

(52) U.S. Cl.
CPC ..... *B65B 9/02* (2013.01); *B65B 13/02* (2013.01); *B65B 41/16* (2013.01); *B65B 51/02* (2013.01); *B65B 65/003* (2013.01)

(58) Field of Classification Search
CPC B65B 9/02; B65B 13/02; B65B 41/16; B65B 51/02; B65B 65/003
USPC ..... 53/399
See application file for complete search history.

(56) References Cited

U.S. PATENT DOCUMENTS 5,078,057 A * 1/1992 Pearson ..... B65B 27/086 100/29
5,289,668 A 3/1994 Meyer
5,345,749 A 9/1994 Tendick
2023/0182942 A1* 6/2023 Köster ..... B65B 13/02 53/148
2024/0400244 A1* 12/2024 Slavinski ..... B65B 35/18

FOREIGN PATENT DOCUMENTS

| | | | |
|---|---|---|---|
| CN | 105947293 | A | 9/2016 |
| CN | 211663611 | U | 10/2020 |
| CN | 114261559 | A | 4/2022 |
| CN | 116729710 | A | 9/2023 |
| CN | 110775382 | B | 2/2024 |

* cited by examiner

*Primary Examiner* — Anna K Kinsaul
*Assistant Examiner* — Mary C Hibbert-Copeland
(74) *Attorney, Agent, or Firm* — Nath, Goldberg & Meyer; Joshua B. Goldberg

(57) ABSTRACT

A system and method of packaging material sheets is provided, which includes loading a pallet onto a conveyor and conveying the pallet in a first direction underneath a packaging dispenser. A base layer of packaging is dispensed onto the pallet from the packaging dispenser as the pallet travels underneath the packaging dispenser after which, material sheets are loaded onto the pallet and base layer of packaging. The material sheets are covered in packaging while traveling in a second direction underneath the packaging dispenser. The length of the pallet may be greater than the width of the conveyor. A first strapping station dispenses straps onto the material sheets in a lengthwise direction and a second strapping station dispenses straps onto the material sheets in a widthwise direction. A pair of laterally movable conveyors may be included for loading of material sheets, and machines may be automatically fold and glue the packaging.

16 Claims, 7 Drawing Sheets

SYSTEM AND METHOD FOR PACKAGING MATERIAL SHEETS

BACKGROUND

Field

The disclosure of the present patent application relates to packaging systems, and particularly to a packaging system for stacks of material sheets, such as sheets of metal.

Description of Related Art

In industrial and manufacturing environments, the efficient packaging of sheet materials-such as metal, plastic, or composite sheets-onto pallets is critical for safe transportation, storage, and distribution of the sheet materials. Traditional methods often rely heavily on manual labor, where multiple workers are required to align, stack, and secure sheets onto pallets. These processes can be time-consuming, labor-intensive, and prone to inconsistency, particularly in high-volume operations.

Automated systems have been introduced to improve efficiency and reduce labor costs. However, existing systems typically involve large, complex machinery that occupies considerable floor space, making them unsuitable for facilities with space constraints. Additionally, such systems often require multiple coordinated subsystems, increasing setup complexity and maintenance needs.

Accordingly, there is a need for an improved system and method of packaging material sheets on pallets that reduces the number of workers required, offers a more compact footprint, and improves operational efficiency.

SUMMARY

In a first embodiment, a method of packaging material sheets is provided by the present disclosure. The method includes loading a pallet onto a conveyor and conveying the pallet in a first direction on a conveyor underneath a packaging dispenser. A base layer of packaging is dispensed onto the pallet from the packaging dispenser as the pallet travels underneath the packaging dispenser. Material sheets are loaded onto the pallet and base layer of packaging after the pallet travels underneath the packaging dispenser. With the base layer and material sheets loaded thereon, the pallet is conveyed in a second direction on the conveyor underneath the packaging dispenser. A top layer of packaging is dispensed onto the material sheets from the packaging dispenser as the pallet travels underneath the packaging dispenser such that the material sheets are covered in packaging when the pallet exits the packaging dispenser. The pallets may be loaded manually onto the conveyor or may be automatically dispensed onto the conveyor from a stack of pallets using a pallet dispensing machine.

The method further includes conveying the pallet and packaged material sheets thereon to a first strapping machine and dispensing straps onto the pallet and packaged material sheets from the first strapping machine in a lengthwise direction of the conveyor. The method further includes conveying the pallet and packaged material sheets thereon to a second strapping machine and dispensing straps onto the pallet and packaged material sheets from the second strapping machine in a widthwise direction. Respective lengths of the pallet, material sheet, and conveyor may be axially aligned, and the length of the pallet may be greater than the width of the conveyor.

The material sheets may be automatically loaded onto the pallet and base layer of packaging by a material sheet dispensing machine. The material sheet dispensing machine may dispense material sheets onto a pair of laterally separable conveyors. The pair of laterally separable conveyors may receive the material sheets from the material sheet dispensing machine and move laterally outward to thereby dispense a material sheet downward onto the pallet and base layer of packaging. The laterally separable conveyors may include ramps on an inner surface thereof on which the material sheets slide down.

The packaging on the material sheets may be automatically folded and glued using a folding and gluing machine. Two folding and gluing machines may be included to perform folding and gluing on side surfaces of the packaged material sheets.

Further provided by the present disclosure is a system for packaging material sheets. The system includes a material sheet and a pallet configured to hold the material sheet thereon. A conveyor is included which is configured to move the pallet in a first direction. The conveyor is further configured to move the pallet with a material sheet thereon in a second direction opposite the first direction. A supply of packaging material is included as well as a packaging dispenser. The packaging dispenser is configured to dispense a layer of packaging material from the supply of packaging material onto the pallet as the pallet travels underneath the conveyor in the first direction. The packaging dispenser is further configured to dispense a second layer of packaging from the supply of packaging material onto the material sheet as the pallet travels underneath the packaging dispenser in the second direction.

The system may include a pallet dispenser configured to automatically dispense a pallet from a stack of pallets onto the conveyor. A folding and gluing machine may be included, which is configured to fold and glue packaging on material sheets as the pallet carrying the material sheets passes the folding and gluing machine.

The system may include a first strapping station and a plurality of straps. The first strapping station is positioned along the conveyor and configured to dispense a strap from the plurality of straps in a lengthwise direction of the conveyor. A second strapping station may be positioned along the conveyor and configured to dispense a strap in a widthwise direction of the conveyor onto the material sheets.

A material sheet dispenser may be included, which is configured to automatically dispense the material sheet onto the pallet. A pair of laterally movable conveyors may be included, which are configured to receive the material sheet from the material sheet dispenser and move laterally outward to dispense the material sheet onto the pallet. The pair of laterally movable conveyors may include ramps thereon for dispensing the material sheet onto the pallet.

In a further embodiment, a system for packaging material sheets is provided including a material sheet and a pallet configured to receive the material sheet thereon. A conveyor is included, which is configured to convey the pallet with the material sheet thereon. A plurality of straps are included as well as a first strapping station. The first strapping station is positioned along the conveyor and configured to dispense a strap from the plurality of straps in a lengthwise direction of the conveyor. A second strapping station is positioned along the conveyor and is configured to dispense a strap from the plurality of straps in a widthwise direction of the conveyor. The system may include a supply of packaging material and a packaging dispenser. The packaging dispenser is configured to dispense a layer of packaging material from the supply of packaging material onto the pallet as the pallet travels underneath the conveyor in a first direction. A second layer of packaging is dispensed by the packaging dispenser onto the pallet with the material sheet thereon as the pallet travels underneath the packaging dispenser in a second direction opposite the first direction.

In another embodiment, a system for packaging material sheets is provided. The system includes a material sheet having a length and a width. A conveyor is included having a width and a length and the conveyor is configured to convey the material sheet thereon. The respective lengths and widths of the material sheet and conveyor are axially aligned. A plurality of straps are included, as well as a first strapping station. The first strapping station is positioned along the conveyor and is configured to dispense a strap from the plurality of straps in a lengthwise direction of the conveyor. A second strapping station is positioned along the conveyor and is configured to dispense a strap from in a widthwise direction of the conveyor. The length of the pallet may be greater than the width of the conveyor.

These and other features of the present subject matter will become readily apparent upon further review of the following specification.

BRIEF DESCRIPTION OF DRAWINGS

Similar reference characters denote corresponding features consistently throughout the attached drawings.

DETAILED DESCRIPTION

Figure 1:
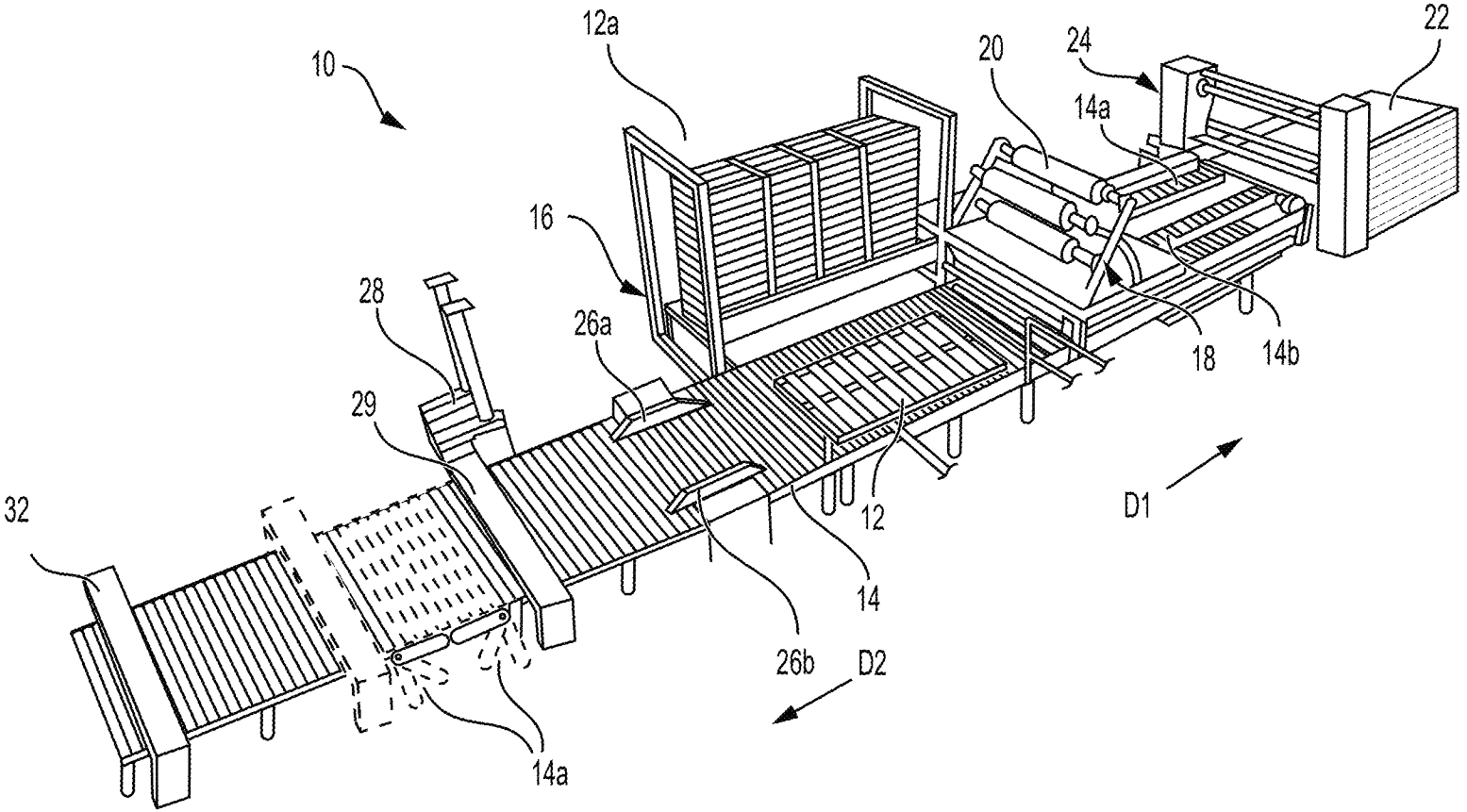
FIG. 1 is an environmental perspective view of a system for packaging material sheets.
Figure 2B:
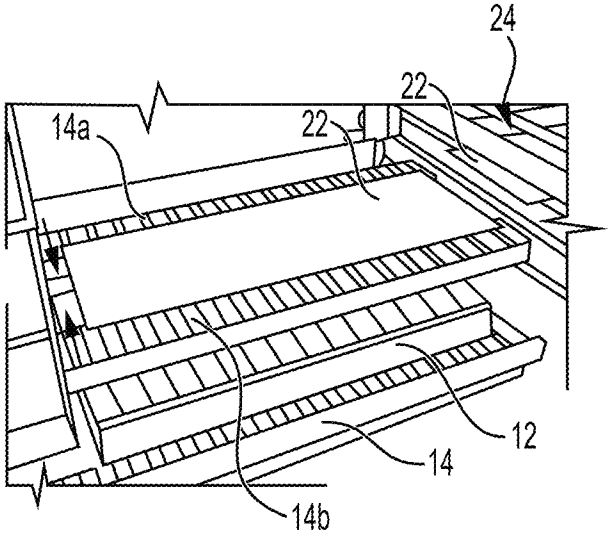
FIG. 2B is an environmental perspective view of a material sheet being dispensed onto a pair of laterally separable conveyors.
Figure 2A:
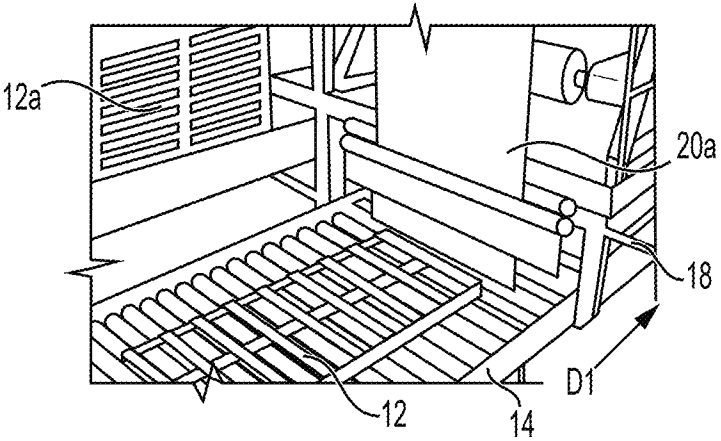
FIG. 2A is an environmental perspective view of a first layer of packaging material being dispensed onto a pallet.
Figure 2D:
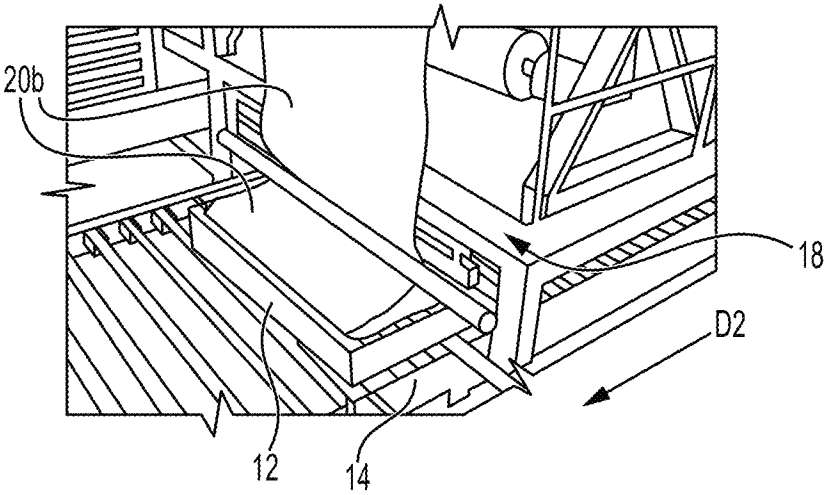
FIG. 2D is an environmental perspective view of a top layer of packaging being dispensed onto a material sheet.
Figure 2C:
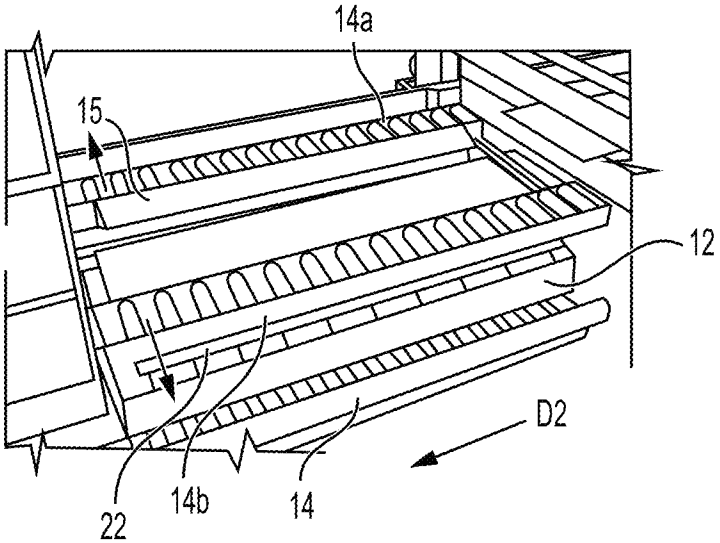
FIG. 2C is an environmental perspective view of a pair of laterally separable conveyors dispensing a material sheet onto a pallet.

Referring to FIGS. 1 and 2A-D, in a first embodiment, a method and system 10 of packaging material sheets is provided by the present disclosure. The method includes loading a pallet 12 onto a conveyor 14. The pallet 12 has a length and a width, with the length being greater than the width. The pallet 12 is loaded onto the conveyor 14 so that the length of the pallet 12 is axially aligned in the direction of travel along the conveyor 14. The pallets 12 may be loaded manually onto the conveyor or may be automatically dispensed onto the conveyor from a stack 12*a* of pallets 12 using a pallet dispensing machine 16. The pallet dispensing machine 16 isolates a bottom pallet from the stack 12*a* of pallets using lift, fork, or finger style mechanisms to lift the stack, and discharge the bottom pallet using an means such as a conveyor or actuator. Pallet 12 is conveyed in a first direction D1 on conveyor 14 underneath a packaging dispenser 18. Conveyor 14 may include multiple motorized rollers for conveying pallet 12 and/or the pallet 12 could be conveyed manually on conveyor 14 with the help of workers. Although shown as a roller conveyor, conveyor 14 could be any suitable type of conveyor such as a belt or other conveyor. A base layer 20*a* (See FIG. 2A) of packaging 20 is dispensed onto the pallet 12 from the packaging dispenser 18 as the pallet 12 travels underneath the packaging dispenser 18. Material sheets 22 are loaded onto the base layer 20*a* of packaging 20 after the pallet 12 travels underneath the packaging dispenser 18.

The material sheets 22 may be loaded onto the base layer 20*a* of packaging 20 manually by workers, or may be loaded automatically from a material sheet dispensing machine 24 (See FIG. 1 and FIG. 2B), which may function, for example, in a similar manner to the pallet dispensing machine, by isolating a bottom sheet material from a stack of sheet material, and dispensing the bottom sheet by a conveyor, actuator, or other means. The material sheet dispensing machine 24 may dispense material sheets onto a pair of laterally separable conveyors 14*a*, 14*b* (See FIG. 2B). The pair of laterally separable conveyors 14*a*, 14*b* may receive the material sheets 22 from the material sheet dispensing machine 24 and simultaneously move outward away from each other to thereby dispense a material sheet 22 downward onto the pallet 12 and base layer of packaging 20*a*. The laterally separable conveyors may include ramps 15 on an inner surface thereof which may help guide the material sheets onto the base layer 20*a* and already-dispensed material sheets 22 on the pallet 12. Alternatively, the laterally separable conveyors 14*a*, 14*b* may be pivotable to an inclined position to slide the material sheets 22 downward onto the pallet 12.

With the base layer 20*a* and material sheets 22 loaded onto the pallet 12, the pallet is conveyed in a second direction D2 on the conveyor 14 underneath the packaging dispenser 18. In a particular embodiment, second direction D2 is a direction opposite first direction D1. A top layer 20*b* of packaging 20 is dispensed onto the material sheets 22 from the packaging dispenser 18 as the pallet 12 travels underneath the packaging dispenser 18 such that the material sheets 22 are covered in packaging 20 when the pallet 12 exits the packaging dispenser 18. It should be understood that packaging 20 is appropriately sized and dispensed such that the width and length of packaging 20 is greater than that of material sheets 22, whereby packaging 20 covers an entire material sheet with sufficient extra packaging present past the edges of the materials sheets to be folded and glued.

Unlike prior art systems, which rely on multiple dispensers of packaging, and the space taken thereby, the present system and method saves space and equipment by relying on a single packaging dispenser machine 18 to provide both base layer 20*a* and top layer 20*b*. By conveying the material sheets and pallet in opposing directions D1 and D2, the front of the material sheets are automatically covered by packaging through the motion of the material sheets and pallet through the dispensed packaging in the direction D2. Once the packaging has covered the length of the material sheets, it may be cut automatically by the packaging dispenser 18. Packaging dispenser 18 may include means for automatic folding and gluing of the front and back sides of the material sheets. Alternatively, a worker may manually cut, fold and glue the packaging on the front and rear sides of the material sheets.

Figure 3B:
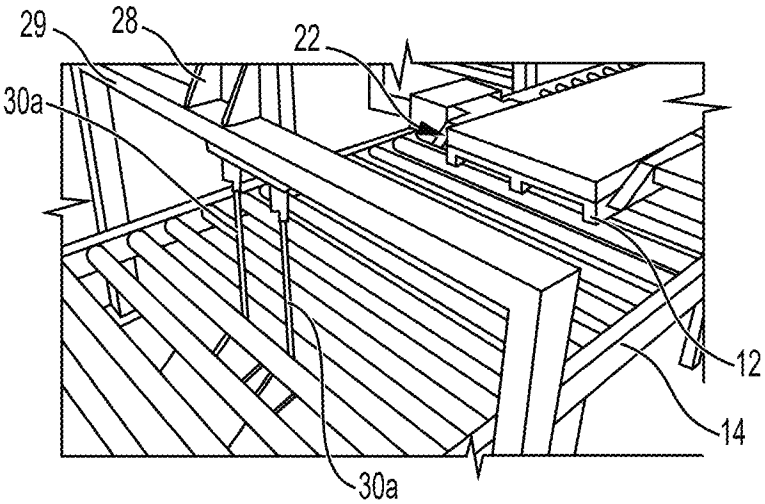
FIG. 3B is an environmental perspective view of a first strapping station.
Figure 3A:
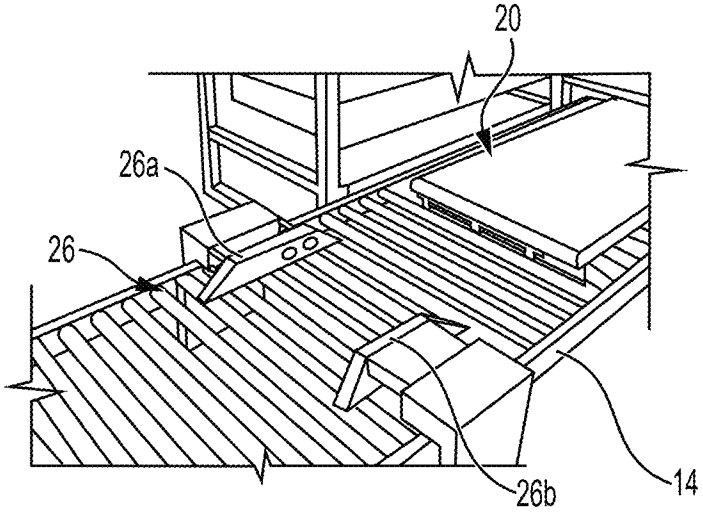
FIG. 3A is an environmental perspective view of a pair of folding and gluing machines.
Figure 3D:
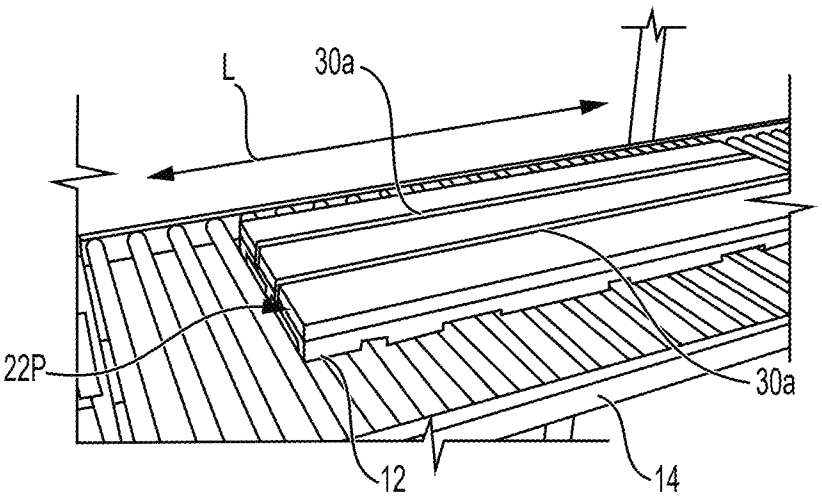
FIG. 3D is an environmental perspective view of packaged material sheets with straps dispensed thereon in a lengthwise direction of a conveyor.
Figure 3C:
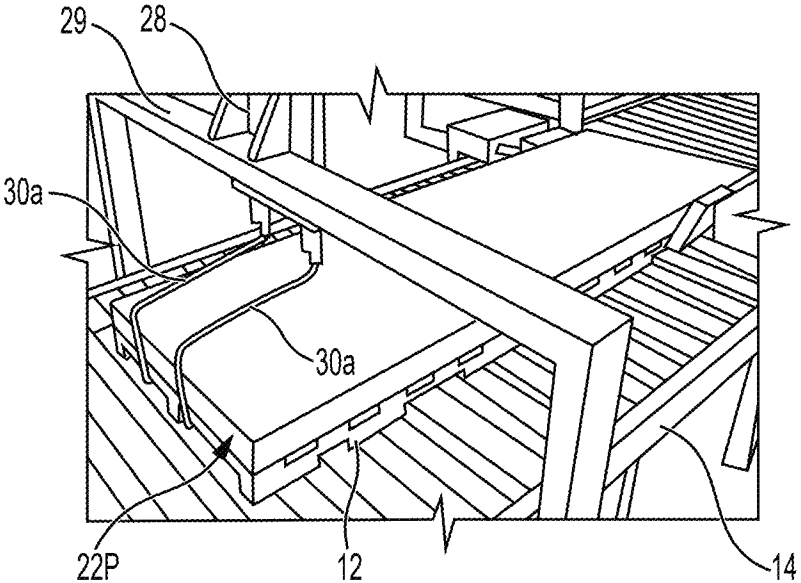
FIG. 3C is an environmental perspective view of straps being dispensed at a first strapping station onto packaged material sheets in a lengthwise direction of a conveyor.

Referring to FIGS. 3A-C, the packaging 20 on the side surfaces of the material sheets 22 may be automatically folded and glued using a folding and gluing machine 26. Such devices are known among the art of packaging and generally include a glue/adhesive dispenser, which dispenses a quantity of glue/adhesive onto the packaging material, as well as one or more abutment surfaces on which the surface of the packaging to be folded intersects, and as the package and packaging contact the abutment surface, the packaging is folded by the movement along the conveyor. Two folding and gluing machines 26*a*, 26*b* may be included to perform folding and gluing on side surfaces of the packaging 20.

Figure 3F:
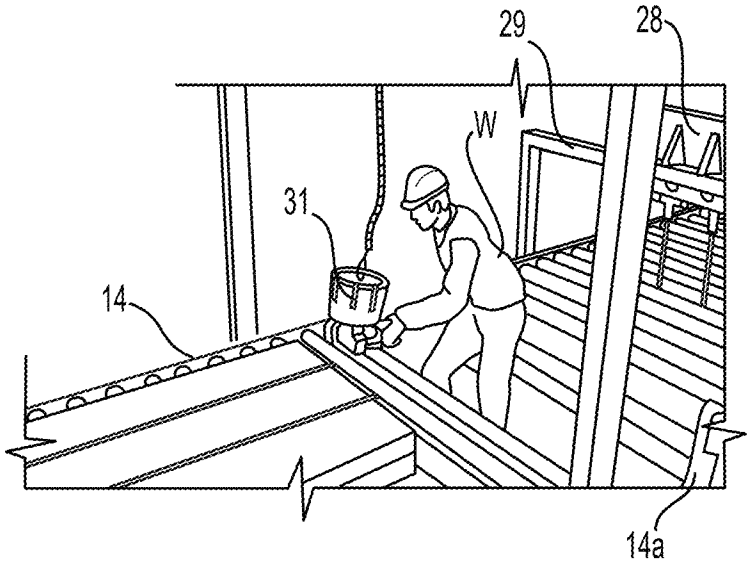
FIG. 3F is an environmental perspective view of a worker tensioning and fastening straps onto packaged material sheets.
Figure 3E:
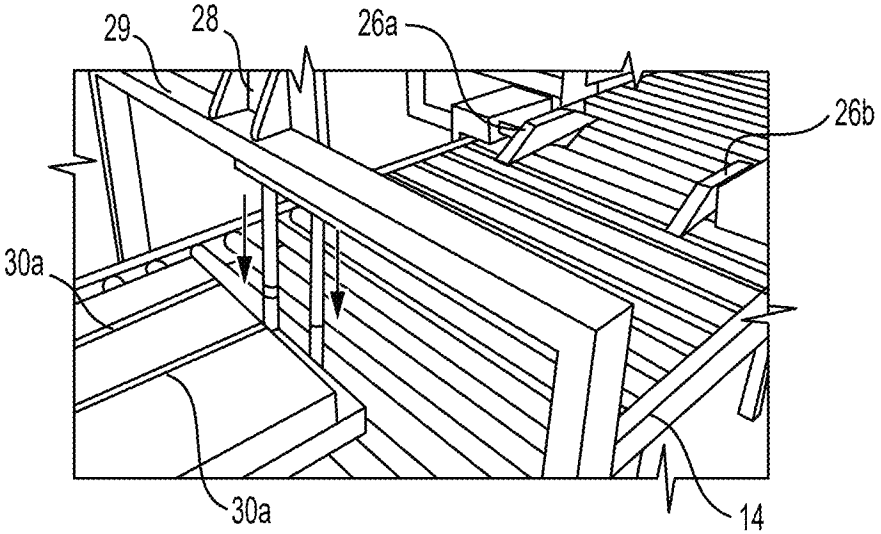
FIG. 3E is an environmental perspective view of straps being dispensed by a first strapping station onto packaged material sheets.

The method further includes conveying the pallet 12 and packaged material sheets 22P (packaged material sheets 22P representing the combination of material sheets 22 with packaging 20 thereon) to a first strapping machine 28 situated on an arch 29 over the conveyor 14. Straps 30*a* are dispensed onto the pallet 12 and packaged material sheets 22P from the first strapping machine 28 in a lengthwise direction L of the pallet 12. Straps 30*a* may be dispensed by the first strapping machine 28, as shown in FIG. 3E. Although not shown, first strapping machine 28 includes a lower machine component situated underneath conveyor 14, which cooperates with the upper component shown on arch 29 and together form the first strapping machine 28. First strapping machine 28 may include a crank for tensioning straps 30*a*, a cutter for severing straps 30*a*, and a means for sealing straps 30*a* such as by friction welding, adhesive dispensing, or crimp dispensing, as examples. Alternatively, as shown in FIG. 3F, workers W could manually perform any of the cutting, gluing, and tensioning of straps 30*a*, with the use of a handheld machine 31, which may likewise be fitted with tensioning, cutting and sealing means as are known among such combination tools used on packaging straps. Optionally, conveyor 14 may be formed in sections and/or may include hinged sections 14*a*, which are hingedly movable between a horizontal position for the passage of pallets 12 thereon and a vertical position by which an opening is formed in conveyor 14 and a worker W may step within the conveyor 14 and perform an operation. It should be understood that the system disclosed herein, including the first strapping machine may be used on any type of package. In some embodiments, the material sheets or any other type of package may be conveyed without the use of a pallet and still receive straps thereon.

Figure 4B:
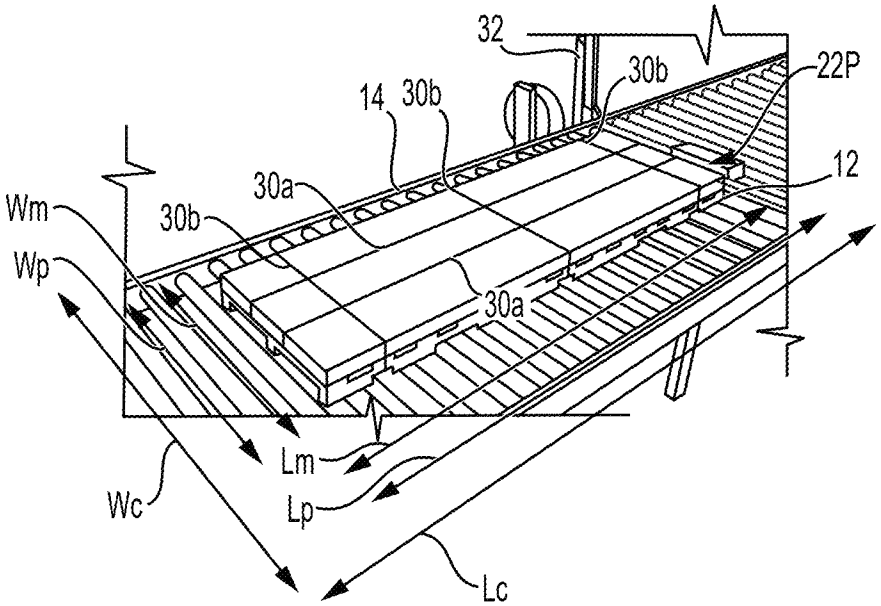
FIG. 4B is an environmental perspective view of packaged material sheets having first and second sets of straps thereon.
Figure 4A:
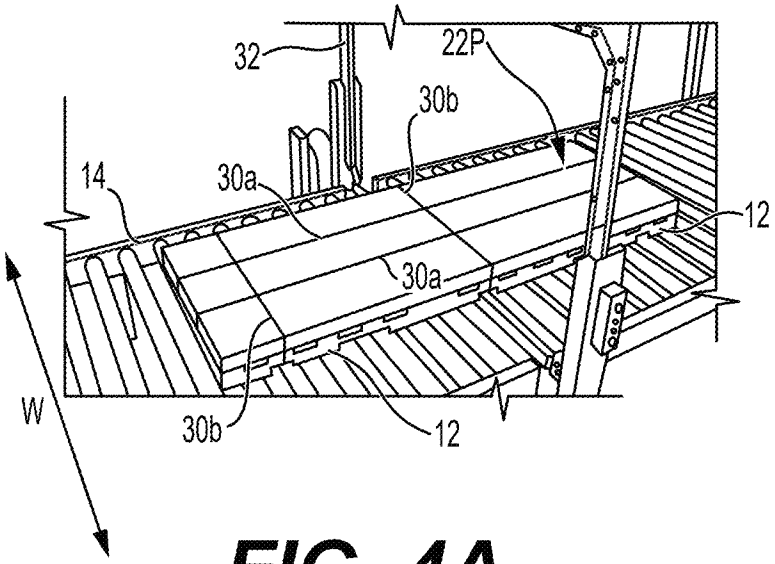
FIG. 4A is an environmental perspective view of a second strapping station used in a system for packaging material sheets.

Turning to FIGS. 4A-B, Turning to FIGS. 4A-B, the system and method for packaging material sheets further includes conveying the pallet 12 and packaged material sheets 22 thereon to a second strapping machine 32 whereby straps 30*b* are dispensed onto the pallet and packaged material sheets from the second strapping machine 32 in a widthwise direction W of the pallet 12. As shown in FIG. 4B, the material sheet length Lm, pallet length Lp, and conveyor length Lc may be axially aligned. Likewise, the material sheet width Wm, pallet width Wp, and conveyor width Wc may be axially aligned.

Unlike prior art systems, the present system advantageously provides for strapping of the material sheets in the lengthwise direction of the conveyor, without the need for rotating the conveyed package, e.g. the material sheets/pallet. In addition, the present method and system allow for the dispensing of straps along the length of the packaged material sheets 22, or other similar package, even in the case of the length Lp or Lm being greater than the width Wc of the conveyor. In prior art systems, the strapping of the length and width of the package is typically done by rotating the package 90 degrees between first and second strapping machines. In such systems, however, strapping may not be possible if the length of the package is greater than the width of the conveyor, which is typically the same width as the strapping machine. Unlike such prior art systems, the present method and system allows for strapping in the lengthwise and widthwise direction of the conveyor, without the need for rotating the conveyed load (e.g. a package, material sheets, and/or pallet) even in the case of the length of the package/material sheet/pallet being greater than the width of the conveyor.

It is to be understood that the systems and methods for packaging material sheets are not limited to the specific embodiments described above, but encompass any and all embodiments within the scope of the generic language of the following claims enabled by the embodiments described herein, or otherwise shown in the drawings or described above in terms sufficient to enable one of ordinary skill in the art to make and use the claimed subject matter.

The invention claimed is:

1. A method of packaging material sheets comprising:

loading a pallet onto a conveyor;

conveying the pallet in a first direction on the conveyor underneath a packaging dispenser;

dispensing a base layer of packaging onto the pallet from the packaging dispenser as the pallet travels underneath the packaging dispenser;

loading material sheets onto the pallet and base layer of packaging;

conveying the pallet, material sheets and base layer of packaging in a second direction on the conveyor underneath the packaging dispenser; and dispensing a top layer of packaging onto the material sheets from the packaging dispenser as the pallet and material sheets travel underneath the packaging dispenser such that the pallet exits the packaging dispenser with packaged material sheets thereon, wherein the material sheets are automatically loaded onto the pallet and base layer of packaging by a material sheet dispensing machine, wherein the material sheet dispensing machine dispenses material sheets onto a pair of laterally separable conveyors, and wherein the pair of laterally separable conveyors receive a material sheet from the material sheet dispensing machine and separate laterally away from each other to thereby dispense the material sheet downward onto the pallet and base layer of packaging.

2. The method of packaging material sheets as recited in claim 1, wherein the pallets are loaded onto the conveyor from a pallet dispensing machine.

3. The method of packaging material sheets as recited in claim 1, further comprising conveying the pallet and packaged material sheets thereon to a first strapping machine and dispensing straps onto the pallet and packaged material sheets from the first strapping machine in a lengthwise direction of the conveyor.

4. The method of packaging material sheets as recited in claim 3, further comprising conveying the pallet and packaged material sheets thereon to a second strapping machine and dispensing straps onto the pallet and packaged material sheets from the second strapping machine in a widthwise direction of the conveyor.

5. The method of packaging material sheets as recited in claim 4, wherein respective lengths of the pallet, material sheet, and conveyor are axially aligned, and wherein a length of the pallet is greater than a width of the conveyor.

6. The method of packaging material sheets as recited in claim 1, further comprising automatically folding and gluing packaging material on the packaged material sheets with a folding and gluing machine.

7. The method of packaging material sheets as recited in claim 6, wherein two folding and gluing machines are included to perform folding and gluing on side surfaces of the packaged material sheets.

8. A system for packaging material sheets comprising:

a material sheet;

a pallet, wherein the pallet is configured to hold the material sheet thereon;

a conveyor, wherein the conveyor is configured to move the pallet in a first direction and the conveyor is configured to move the pallet with a material sheet thereon in a second direction opposite the first direction;

a supply of packaging material;

a packaging dispenser, wherein the packaging dispenser is configured to dispense a layer of packaging material from the supply of packaging material onto the pallet as the pallet travels underneath the conveyor in the first direction, and dispense a second layer of packaging from the supply of packaging material onto the pallet with a material sheet thereon as the pallet with material sheet thereon travels underneath the packaging dispenser in the second direction;

a material sheet dispensing machine, wherein the material sheets are automatically loaded onto the pallet and base layer of packaging by the material sheet dispensing machine, and wherein the material sheet dispensing machine dispenses material sheets onto a pair of laterally separable conveyors; and a pair of laterally movable conveyors, wherein the pair of laterally separable conveyors receive a material sheet from the material sheet dispensing machine and separate laterally away from each other to thereby dispense the material sheet downward onto the pallet and base layer of packaging.

9. The system for packaging material sheets as recited in claim 8, further comprising a pallet dispenser, wherein the pallet dispenser is configured to automatically dispense a pallet from a stack of pallets onto the conveyor.

10. The system for packaging material sheets as recited in claim 8, further comprising a folding and gluing machine, wherein the folding and gluing machine is configured to fold and glue packaging on the pallet with material sheet thereon as the pallet with material sheet thereon passes the folding and gluing machine on the conveyor.

11. The system of packaging material sheets as recited in claim 8, further comprising a first strapping station and a plurality of straps, wherein the first strapping station is positioned along the conveyor and configured to dispense a strap from the plurality of straps in a lengthwise direction of the conveyor.

12. The system for packaging material sheets as recited in claim 11, further comprising a second strapping station positioned along the conveyor and configured to dispense a strap in a widthwise direction of the conveyor.

13. The system for packaging material sheets as recited in claim 12, wherein respective lengths of the pallet, material sheet, and conveyor are axially aligned, and wherein a length of the pallet is greater than a width of the conveyor.

14. A system for packaging material sheets, the system comprising:

a material sheet, wherein the material sheet has a length and a width;

a conveyor, wherein the conveyor has a width and a length and is configured to convey the material sheet thereon and wherein the respective lengths of the material sheet and conveyor are axially aligned, and wherein the respective widths of the material sheet, and conveyor are axially aligned;

a plurality of straps;

a first strapping station, wherein the first strapping station is positioned along the conveyor and is configured to dispense a strap from the plurality of straps in a lengthwise direction of the conveyor;

a second strapping station, wherein the second strapping station is positioned along the conveyor and is configured to dispense a strap from the plurality of straps in a widthwise direction of the conveyor;

a material sheet dispensing machine, wherein the material sheets are automatically loaded onto the pallet and base layer of packaging by the material sheet dispensing machine, and wherein the material sheet dispensing machine dispenses material sheets onto a pair of laterally separable conveyors; and a pair of laterally movable conveyors, wherein the pair of laterally separable conveyors receive a material sheet from the material sheet dispensing machine and separate laterally away from each other to thereby dispense the material sheet downward onto the pallet and base layer of packaging.

15. The system for packaging material sheets as recited in claim 14, wherein the length of the material sheet is greater than the width of the conveyor, and wherein the first strapping station is configured to dispense a strap over the length of the pallet.

16. The system for packaging material sheets as recited in claim 14, further comprising:

a supply of packaging material;

a packaging dispenser, wherein the packaging dispenser is configured to dispense a layer of packaging material from the supply of packaging material onto the pallet as the pallet travels underneath the conveyor in a first direction, and dispense a second layer of packaging from the supply of packaging material onto the pallet with the material sheet thereon as the pallet with material sheet thereon travels underneath the packaging dispenser in a second direction opposite the first direction; and a folding and gluing machine, wherein the folding and gluing machine is configured to glue and fold packaging material on the material sheet as the pallet with material sheet thereon passes the folding and gluing machine in the second direction.

* * * * *